US007501880B2

(12) United States Patent
Bonaccio et al.

(10) Patent No.: US 7,501,880 B2
(45) Date of Patent: Mar. 10, 2009

(54) BODY-BIASED ENHANCED PRECISION CURRENT MIRROR

(75) Inventors: Anthony R. Bonaccio, Shelburne, VT (US); Hayden C. Cranford, Jr., Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 113 days.

(21) Appl. No.: 10/906,628

(22) Filed: Feb. 28, 2005

(65) Prior Publication Data

US 2006/0192611 A1 Aug. 31, 2006

(51) Int. Cl.
*G05F 1/10* (2006.01)

(52) U.S. Cl. ..... 327/534; 327/535; 327/538

(58) Field of Classification Search ..... None
See application file for complete search history.

(56) References Cited

U.S. PATENT DOCUMENTS

| | | | | |
|---|---|---|---|---|
| 6,016,051 | A * | 1/2000 | Can | 323/315 |
| 6,087,894 | A | 7/2000 | Barrett, Jr. et al. | 327/543 |
| 6,465,999 | B2 | 10/2002 | D'Angelo | 323/316 |
| 6,614,280 | B1 | 9/2003 | Panwitz | 327/307 |
| 6,677,802 | B2 * | 1/2004 | Strom et al. | 327/534 |
| 6,683,489 | B1 | 1/2004 | Eker | 327/538 |
| 6,864,539 | B2 * | 3/2005 | Ishibashi et al. | 257/368 |
| 6,911,858 | B2 * | 6/2005 | Mori | 327/307 |
| 6,917,237 | B1 * | 7/2005 | Tschanz et al. | 327/513 |
| 6,927,621 | B2 * | 8/2005 | Yamada | 327/537 |
| 2002/0145464 | A1 * | 10/2002 | Shor et al. | 327/536 |
| 2002/0190782 | A1 * | 12/2002 | Somerville et al. | 327/540 |
| 2003/0042968 | A1 | 3/2003 | Strom et al. | 327/534 |
| 2003/0207504 | A1 * | 11/2003 | Fuselier et al. | 438/151 |
| 2005/0185572 | A1 * | 8/2005 | Resta et al. | 370/205 |
| 2005/0226051 | A1 * | 10/2005 | Bedarida et al. | 365/185.18 |
| 2006/0022745 | A1 * | 2/2006 | Nakamura | 327/541 |
| 2006/0132218 | A1 * | 6/2006 | Tschanz et al. | 327/534 |
| 2006/0145752 | A1 * | 7/2006 | Kim | 327/544 |

* cited by examiner

*Primary Examiner*—Tuan T Lam
*Assistant Examiner*—Hiep Nguyen
(74) *Attorney, Agent, or Firm*—W. Riyon Harding

(57) ABSTRACT

A body-biased enhanced current mirror circuit is disclosed wherein the body voltage of a current mirror device is adjusted to compensate for the effect of changes in the output voltage on the output current, increasing the output impedance. For each instance of the current mirror, this approach has the advantage of requiring no additional margin in operating voltage and of consuming no more circuit area than prior art current mirror designs. In addition, the body-biased enhanced current mirror circuit provides a stable reference current to output current ratio over a wide operating range. An auxiliary MOSFET current mirror device with the body connected to ground may be added in parallel with the body-biased current mirror device to eliminate a non-monotonicity of the current output.

24 Claims, 6 Drawing Sheets

BODY-BIASED ENHANCED PRECISION CURRENT MIRROR

FIELD OF THE INVENTION

The field of the invention relates to a current reference integrated circuit and more particularly to a current reference circuit incorporating a biasing scheme to modulate the threshold voltage of an output device of a current mirror to compensate for the effect of a change in output voltage on the output current.

BACKGROUND OF THE INVENTION

A MOSFET current mirror is an essential component of integrated circuit amplifiers that is used to implement current sources for biasing and may also operate as an active load. The MOSFET current mirror typically includes at least two devices configured such that the ratio of currents through each device remains largely constant. The current ratio is controlled by the physical geometry of the transistors, which enables the current flowing through an output device to be approximated by reference to the current flowing through a reference device. In this regard, current in the output device is proportional to the current in the reference device, thereby "mirroring" the reference current.

A current reference circuit producing a stable output current in the presence of fluctuations in the voltage applied at its output is useful in analog circuits where variables may be expressed as a simple current, a ratio of currents, or a biased reference current. To stabilize the output current, many current reference circuits incorporate some form of feedback. The reference and output transistors of a typical current mirror have non-linear current versus voltage characteristics that are well matched, thereby producing a current ratio that is ideally constant over a wide output voltage range.

However, MOSFET transistors are rendered imperfect current sources because a voltage applied to the drain—typically the output when the transistor is used as a current source—causes a modulation of the size of the drain-channel depletion region. As the drain voltage increases, the size of the depletion region grows and the effective channel length is decreased. As a result, the drain current increases as well, hence degrading operation of the device as a constant current source. This tendency can be determined from the saturated drain current equation:

$$I_d = \tfrac{1}{2}(\mu_n C_{ox})\cdot(W_{eff}/L_{eff})\cdot(V_{gs}-V_t)^2$$

where $I_d$ clearly increases as $L_{eff}$ decreases. In general, $L_{eff}$ is regarded as fixed and another term is added to the equation to account for channel length modulation:

$$I_d = \tfrac{1}{2}(\mu_n C_{ox})\cdot(W_{eff}/L_{eff})\cdot(V_{gs}-V_t)^2\cdot(1+\lambda V_{ds})$$

that models the dependency of $I_d$ on $V_d$ as a linear approximation.

There are two prior art approaches in dealing with the undesirable change in drain current associated with modulation of the drain depletion region. One is to simply make the design channel length larger, which lessens the effect of the depletion region modulation. The change in dimension of the depletion region is a fixed function of the drain voltage and drain doping but not of the channel length. This has the effect of reducing the value of $\lambda$ in equation 2 above and "flattening" the device curves in the saturation region. However, this technique suffers from either an increase in area with the square of the increase in $L_{eff}$ (since $W_{eff}$ needs to increase by the same proportion) or an increase of the voltage bias margin required for the current source to operate properly in the saturation region.

Another technique is to add circuitry to the basic MOSFET current mirror that will increase the output resistance. There are literally dozens of circuit topologies designed to provide higher output impedance, the simplest and most straightforward of these being to place a common-gate cascode device immediately in series with the drain of the current mirror. This has the effect of isolating the drain of the current mirror from variations in the voltage at the output of the mirror circuit; the drain observes a voltage set only by the cascode gate bias and the cascode gate-to-source voltage, which is a weak function of the current through the device. Unfortunately, this technique has the disadvantage of requiring additional circuit area and an additional voltage bias margin across the aggregate mirror structure (the mirror and cascode devices) in order for the cascode device to function properly.

Accordingly, a need exists for a current mirror with improved output impedance characteristics that does not present a significant impact to the area and voltage bias margin of the current mirror device.

SUMMARY OF THE INVENTION

A first aspect of the invention is directed to a technique for increasing the output impedance of a MOSFET current source without significant penalty in circuit area or increase in operating voltage. A current mirror circuit is disclosed with a body-bias voltage adjustment capability to compensate for the effect of a change in output voltage on the output current. For each instance of the current mirror, this approach has the advantage of requiring no additional margin in operating voltage and of consuming no more circuit area than prior art current mirror designs. In addition, the body-biased-enhanced current mirror circuit provides a stable reference current to output current ratio over a wide operating range.

DETAILED DESCRIPTION OF THE PREFERRED EMBODIMENTS

In the following detailed description of embodiments, reference is made to the accompanying drawings which form a part hereof, and in which are shown byway of illustration specific embodiments that are described in sufficient detail to enable those skilled in the art to practice the invention, and it is to be understood that other embodiments may be utilized and logical, structural, electrical and other changes may be made without departing from the scope of the present invention.

Just as channel-length modulation is a well known effect that modifies the output current in a MOSFET current mirror, the body effect in MOSFET technology is known to vary the threshold voltage of a MOSFET transistor as a function of the transistor's source-to-body potential. For example, in an n-type MOSFET (NFET) transistor, assuming the body potential is held constant, as the source potential increases the device threshold voltage also increases. If the gate-to-source potential is also fixed, that is, the change in gate voltage corresponds exactly with the change in source voltage, the current in the device decreases because the threshold voltage increases as a result of the body effect. This drain current decrease, if properly adjusted and controlled, can precisely counteract the increase in drain current that would result from an increase in drain voltage. Accordingly, if the drain voltage can be monitored and selectively applied to increase the source-to-body potential, the output conductance of a current mirror could, in principle, be set to zero, which corresponds to a high output impedance since impedance is inversely proportional to conductance.

For the example of an NFET transistor serving as the current mirror, the source is typically grounded and the gate is biased at a potential somewhere above the threshold voltage by the "reference" leg of the mirror. Therefore in order to modify the drain current by changing the source-to-body potential, this invention controls the body potential rather than the source potential. The body voltage of the current mirror device is initially set to some value and then altered as a function of the output voltage of the current mirror device, which is typically imposed by the circuit in which the current mirror is used, rather than by the current mirror device itself.

Figure 1:
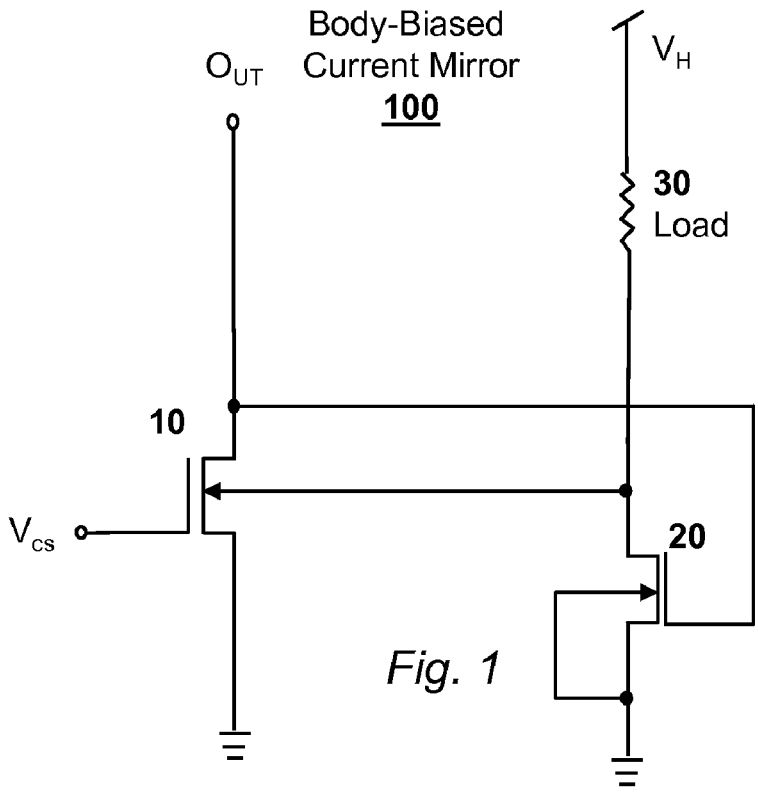
FIG. 1 illustrates a schematic diagram of a body-biased current mirror according to a first embodiment of the invention.

Referring to FIG. 1, an exemplary NFET-based body-biased current mirror 100 according to a first embodiment is shown. The gate voltage of NFET current mirror device 10 is set by a current mirror reference voltage $V_{CS}$, and the drain voltage is monitored by NFET body feedback amplifier 20. If the drain voltage of current mirror device 10 increases, body feedback amplifier 20 turns on harder, which decreases the voltage on the body of current mirror device 10. As a result, the tendency of the current of current mirror device 10 to increase with increasing drain voltage is counteracted by the resultant increase in the threshold voltage. This increases the apparent output impedance of current mirror device 10.

As shown in FIG. 1, resistor 30 is a load element for the body feedback amplifier 20 that is tied to power supply $V_H$. While this circuit topology is conceptually feasible, it has a number of disadvantages, such as requiring significantly increased area and additional processing steps to implement the load as a resistor.

Figure 2:
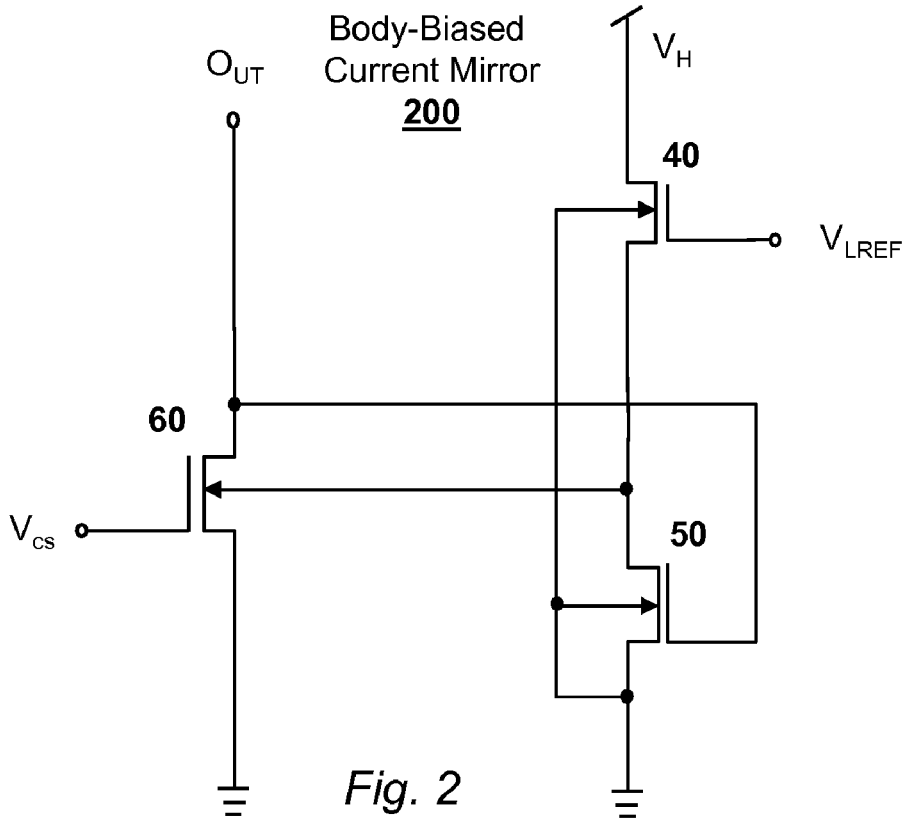
FIG. 2 illustrates a schematic diagram of a body-biased current mirror according to a second embodiment of the invention.

A smaller and therefore more practical implementation for the current mirror is shown in FIG. 2, which depicts an exemplary NFET-based body-biased current mirror 200. In this second embodiment, the load element for NFET body feedback amplifier 50 is represented by FET load device 40 whose gate is tied to a load reference voltage $V_{LREF}$ and whose body is tied to the body of body feedback amplifier 50. This circuit operates in the same way as the circuit shown in FIG. 1, and in addition FET load device 40 provides a more efficient layout. Body feedback amplifier 50 is optionally a low-threshold or zero-threshold MOSFET transistor, which will turn on in response to very low voltages at the drain of NFET current mirror device 60. As such, the voltage requirement for the mirror is not increased to accommodate the body-biasing network.

A circuit for generating the load reference voltage $V_{LREF}$ and the current mirror reference voltage $V_{CS}$ is now disclosed. Since the reference voltages may be commonly applied across a large number of current mirror instances, the circuit used to generate these voltages can be somewhat more complex without adding too much overhead. An exemplary circuit for accomplishing the generation of load reference voltage $V_{LREF}$ and current mirror reference voltage $V_{CS}$ is shown in FIG. 3.

Figure 3:
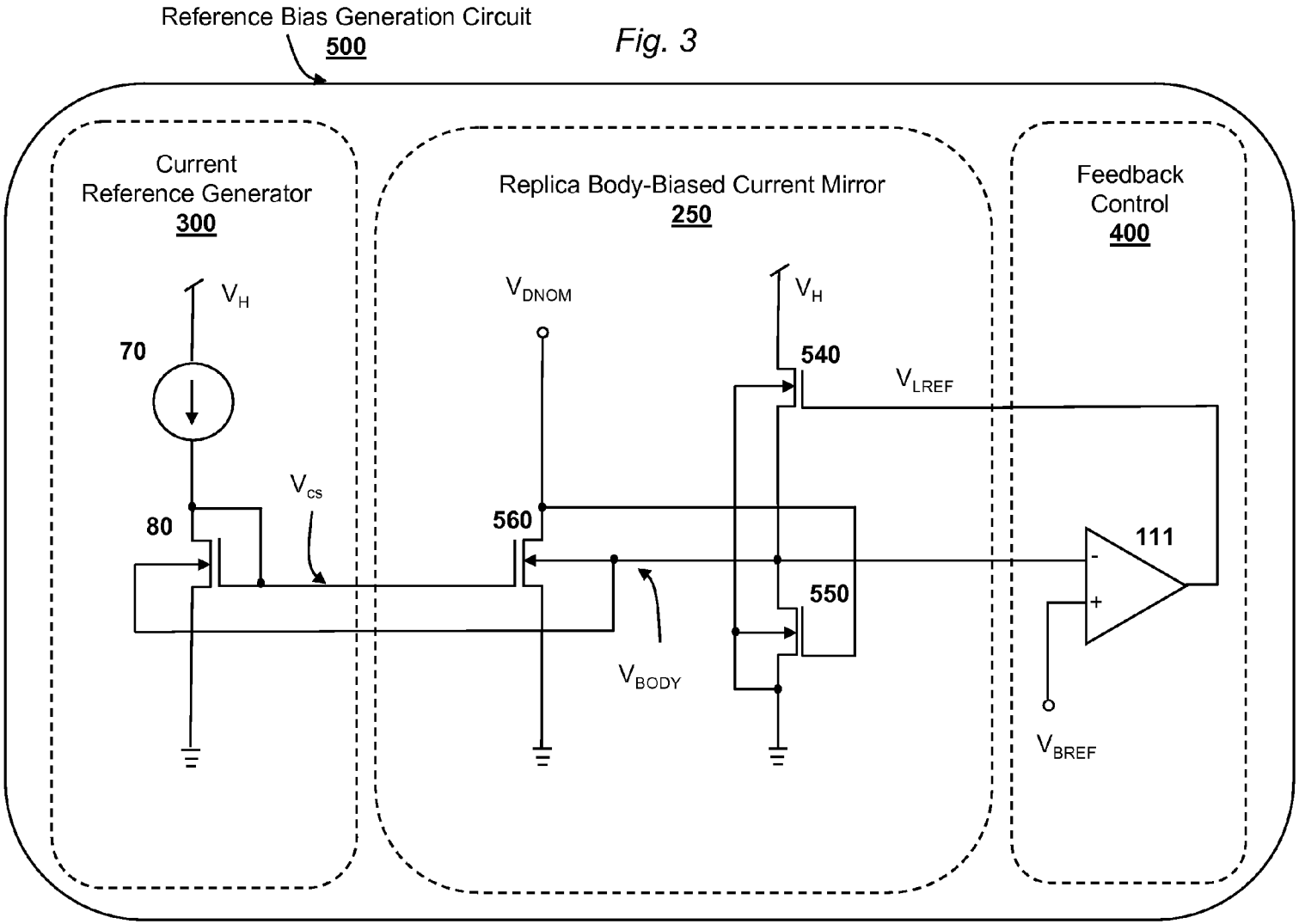
FIG. 3 illustrates a schematic diagram of a reference bias generation circuit to control the biases of a plurality of the circuits shown in FIG. 2.

Reference bias generation circuit 500 in FIG. 3 is segmented into three sub-circuits: current reference generator 300, replica body-biased current mirror 250, and feedback control 400. Current reference generator 300 is similar to a traditional circuit for setting the reference voltage $V_{CS}$ to a current mirror. The input current 70 to be mirrored is forced through diode-connected NFET reference device 80 and the resulting gate voltage, current mirror reference voltage $V_{CS}$, is used to bias the gate of NFET current mirror device 560. Unlike a traditional current reference generator, however, current reference generator 300 has a minor modification such that the body of diode-connected reference device 80, instead of being grounded, is controlled to the same voltage as that of NFET current mirror device 560, thereby keeping the threshold voltages of the two devices (80, 560) the same and maintaining a constant current ratio between them.

The second circuit component shown in reference bias generation circuit 500 in FIG. 3 is a replica body-biased current mirror 250. In the reference bias generation circuit 500, both the drain and body voltages of NFET current mirror device 560 in replica body-biased current mirror 250 are controlled to selected values. The drain is set to a DC voltage applied at node $V_{DNOM}$ that is chosen to be at or near the voltage expected at the output of one or more instantiations of a body-biased current mirror that will be connected to reference bias generation circuit 500. The body voltage at node $V_{BODY}$ is set to a body reference voltage $V_{BREF}$ by feedback control 400, the third circuit component shown in reference bias generation circuit 500. A low-frequency, low-precision operational amplifier 111 in feedback control 400 forces the body voltage of current mirror device 560 at node $V_{BODY}$ to match the voltage $V_{BREF}$ connected to the (+) terminal of operational amplifier 111 and adjusts the gate of FET load device 540 to whatever value is needed, such that the current in NFET body feedback amplifier 550, whose gate-to-source voltage is set by the voltage at node $V_{DNOM}$ and whose drain-to-source voltage is set by the voltage at node $V_{BODY}$, matches the current in FET load device 540. The body reference voltage $V_{BREF}$ is generated elsewhere on the integrated circuit, and its value is set to prevent forward biasing of the body-to-diffusion junction(s) of current mirror device 560 and diode-connected reference device 80 in reference bias generation circuit 500, and in any body-biased current mirror device that is to be connected to reference bias generation circuit 500. The value preferably tracks the voltage across a body-to-diffusion junction with temperature and process variation. The resulting voltage at the gate of FET load device 540 is the load reference voltage $V_{LREF}$. Load reference voltage $V_{LREF}$ and current mirror reference voltage $V_{CS}$ may be applied across each instantiation of the body-biased current mirror in the integrated circuit.

Figure 4:
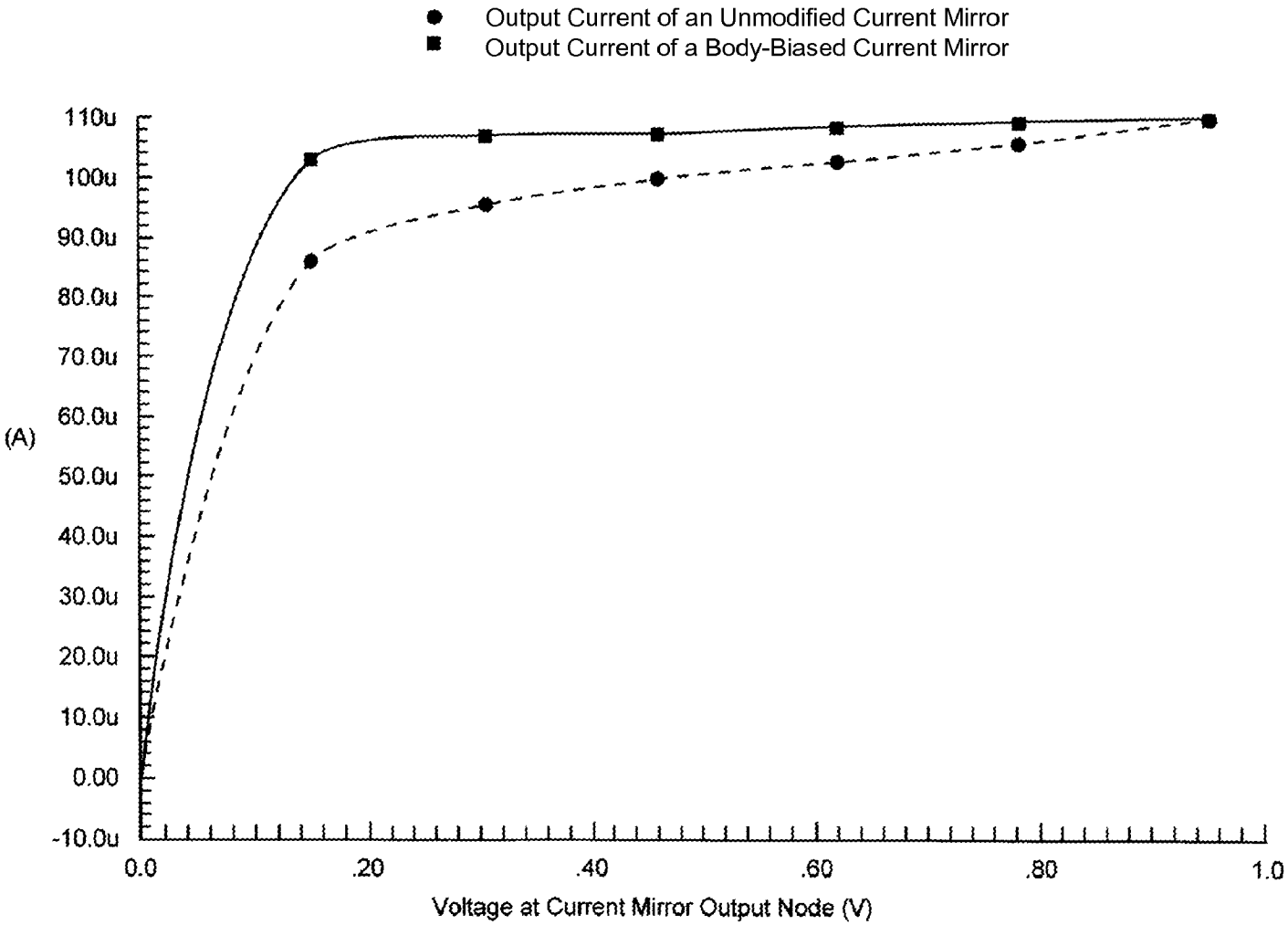
FIG. 4 shows a simulation of an output current plotted versus voltage corresponding to an unmodified current mirror and to a body-biased current mirror.

The technique and circuits described have been simulated and the following results have been demonstrated. Referring to FIG. 4, two output waveforms are shown. One waveform represents the output current of an unmodified prior art current mirror (dashed curve). The other waveform represents the output current of a body-biased current mirror 200 (solid curve) according to the second embodiment as shown in FIG. 2, whose load reference voltage $V_{LREF}$ and current mirror reference voltage $V_{CS}$ are generated by a reference bias generation circuit 500 as shown in FIG. 3. In all circuits the channel length was specified as three times a ground rule minimum for an exemplary 0.09 μm process technology. The drain voltage is swept from 0 V to 0.95 V over the period of the analysis. As shown in FIG. 4, the output current of the body-biased current mirror using the technique and circuits of the present invention exhibits a much flatter response for voltages greater than approximately 0.2 V than the output current of the prior art current mirror, demonstrating improved output impedance characteristics.

Figure 5:
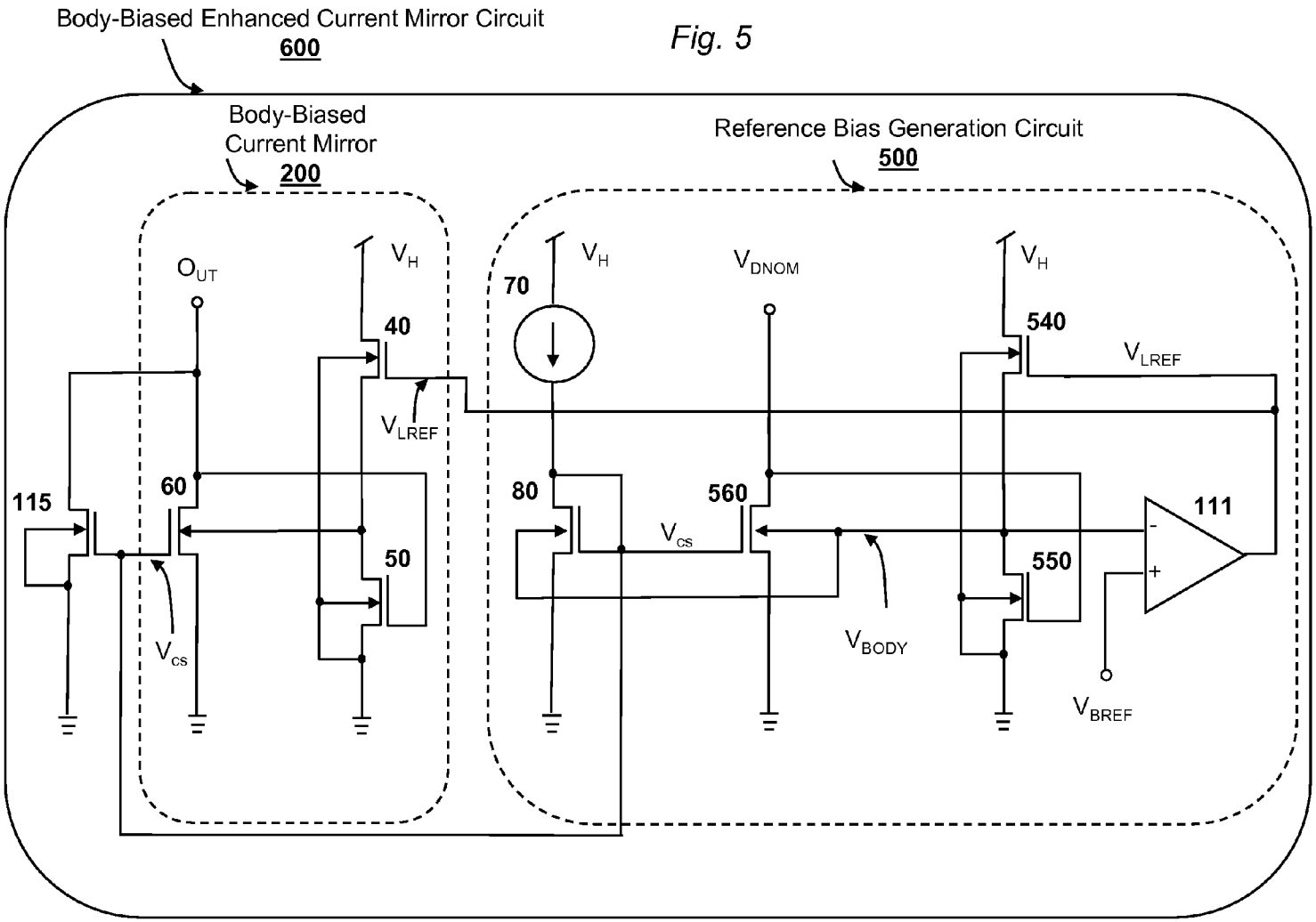
FIG. 5 illustrates a schematic diagram of a body-biased enhanced current mirror circuit according to a third embodiment having at least one instantiation of a body-biased current mirror and an auxiliary grounded-body current mirror device.

Referring to FIG. 5, a body-biased enhanced current mirror circuit 600 according to a third embodiment is shown. In FIG. 5, an instantiation of body-biased current mirror 200 is coupled in parallel with the reference bias generation circuit 500 of FIG. 3. It is noted that multiple instantiations of body-biased current mirror 200 may be placed across the integrated circuit coupled in parallel with a single reference bias generation circuit 500.

Figure 6:
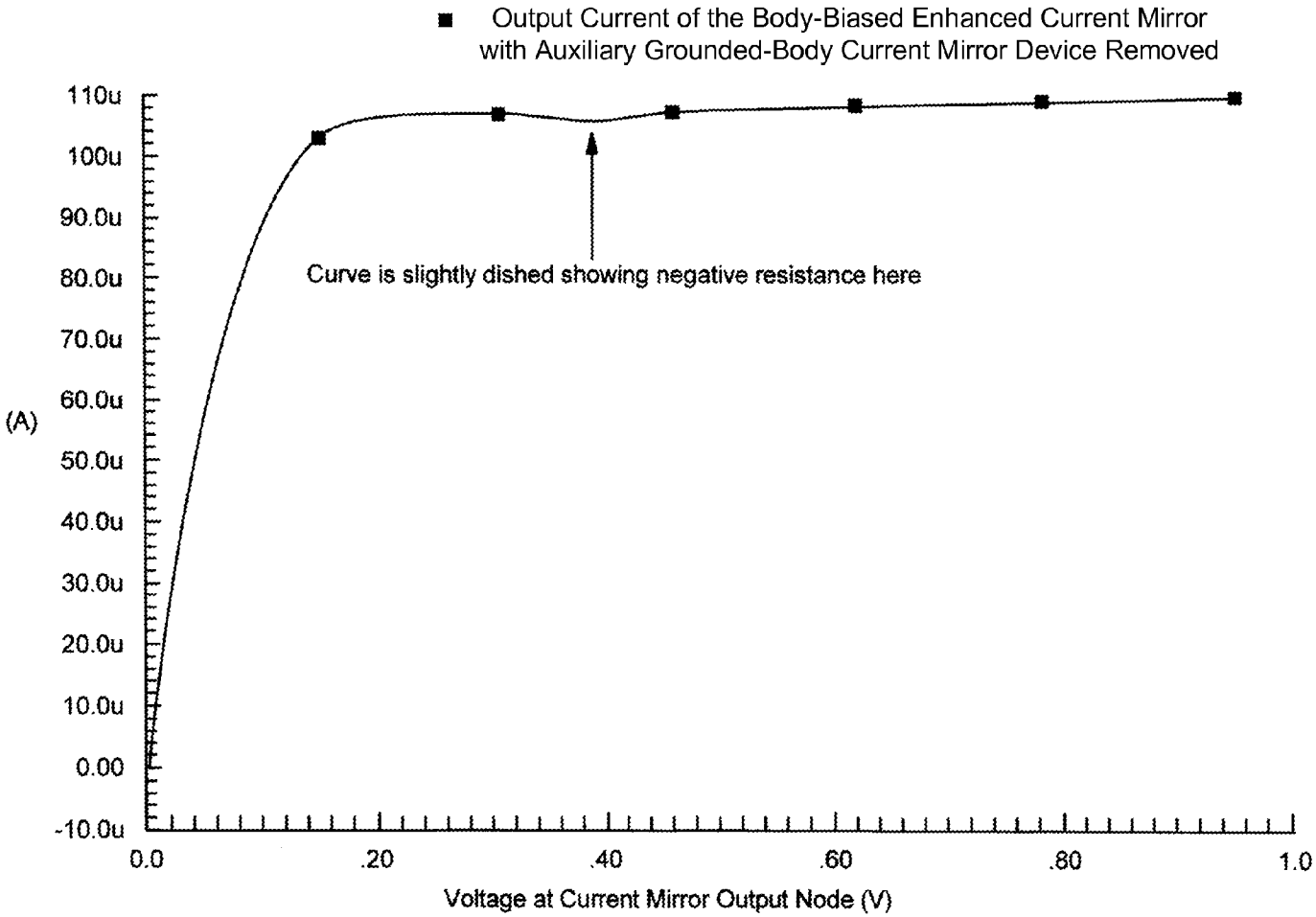
FIG. 6 plots the simulated output current of the body-biased enhanced current mirror circuit with the auxiliary grounded-body current mirror device removed, exhibiting a non-monotonic current response at the current mirror output node.

Also shown in FIG. 5 is an auxiliary NFET current mirror device 115 that is connected in parallel with NFET current mirror device 60 of instantiated body-biased current mirror 200. The body of auxiliary current mirror device 115 is connected to ground as in the unmodified prior art current mirror. Without the addition of auxiliary grounded-body current mirror device 115, the output current vs. output voltage characteristic at the drain of current mirror device 60 in body-biased current mirror 200 of FIG. 5 may be non-monotonic, as shown in the DC analysis simulation of FIG. 6. The output current of current mirror device 60 can be made to be monotonic over a range of interest of its output voltage by selection of the transistor sizes in the load reference voltage feedback path. By changing the aspect ratios of transistors 540, 550, 40, and 50, a non-monotonic response of the output current of current mirror device 60 versus its output voltage may be emphasized or inhibited.

In many current mirror applications, the presence of a non-monotonic section of the output current vs. output voltage characteristic is undesirable as it can be viewed as a "negative resistance" region. The addition of auxiliary grounded-body current mirror device 115 in parallel with current mirror device 60 as shown in FIG. 5 helps to eliminate the non-monotonic tendency of the output current of current mirror device 60. To optimize the body-biased enhanced current mirror circuit 600 shown in FIG. 5, which includes an instantiation of body-biased current mirror 200, reference bias generation circuit 500, and auxiliary grounded-body current mirror device 115, the width of current mirror device 60 was decreased by an amount approximately equal to the width that auxiliary grounded-body current mirror device 115 added.

Figure 7:
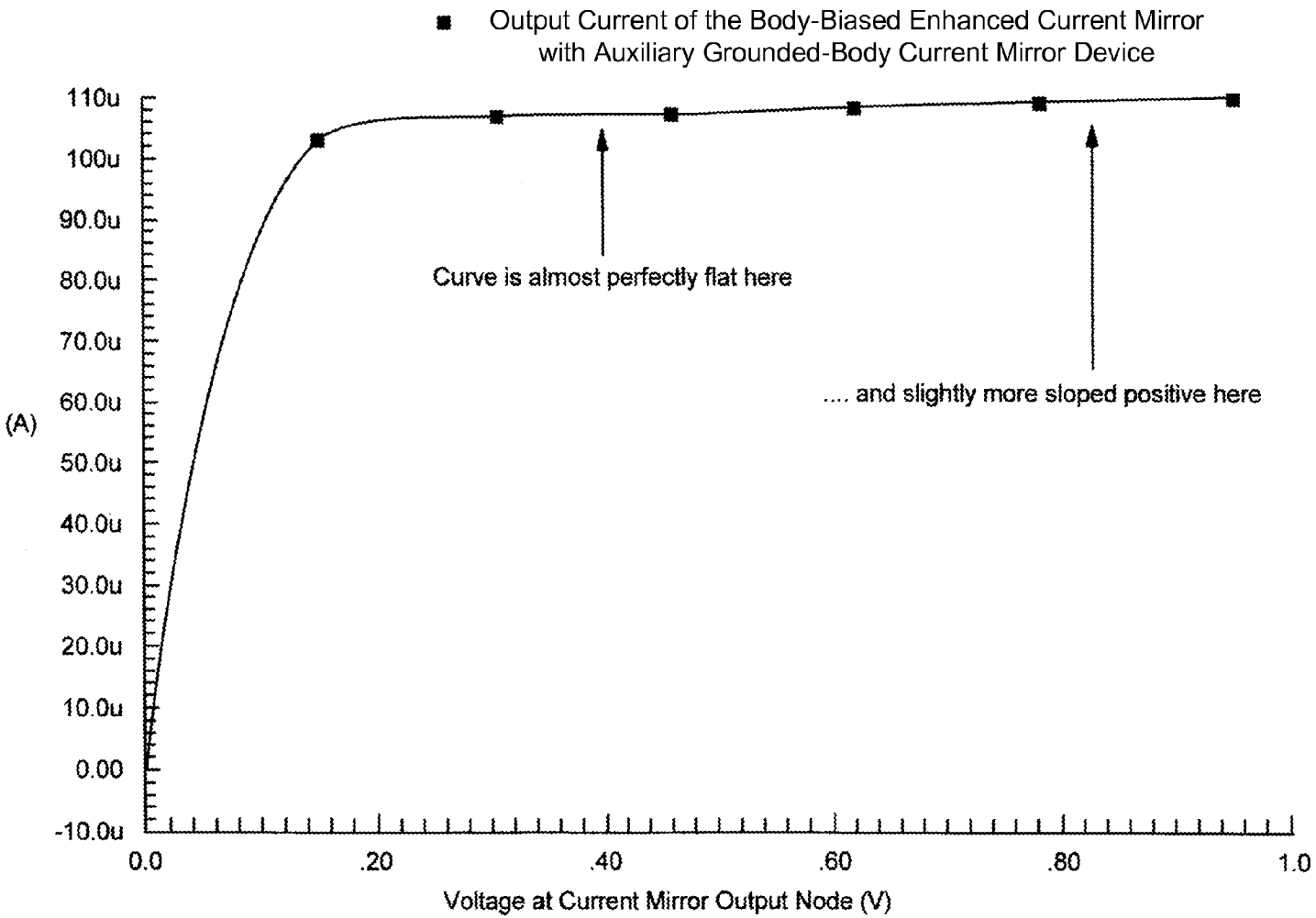
FIG. 7 plots the simulated output current of the body-biased enhanced current mirror circuit with the auxiliary grounded-body current mirror device included, exhibiting a near optimal current response at the current mirror output node.

FIG. 7 depicts a simulation plot of the output current of body-biased enhanced current mirror circuit 600 of FIG. 5 measured at the node OUT, in which the output current at node OUT is the combined current flowing into the drain of current mirror device 60 and into the drain of auxiliary grounded-body current mirror device 115. It can be seen in FIG. 7 that the output response for the body-biased enhanced current mirror circuit 600 provides a nearly flat and slightly positively sloped response as compared to the output response for the body-biased enhanced current mirror circuit 600 with the auxiliary grounded-body current mirror device removed shown in FIG. 6. By changing the aspect ratios of the transistors in the load reference voltage feedback path and by adding auxiliary grounded-body current mirror device 115, a near optimal response is realized.

While the invention has been described with reference to a preferred embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A body-biased current mirror circuit comprising:

a first current mirror device (60) driven by a first reference voltage ($V_{CS}$);

a first body feedback amplifier (50) coupled to the first current mirror device (60), the first body feedback amplifier (50) configured to regulate a body voltage of the first current mirror device (60) as a function of an output voltage of the first current mirror device (60); and a first load element (40) having an output coupled to an output of the first body feedback amplifier (50); a body of the first load element (40) further coupled to a body of the first body feedback amplifier (50).

2. The body-biased current mirror circuit according to claim 1, wherein the first load element (40) comprises a first MOSFET having a gate voltage regulated by a second reference voltage ($V_{LREF}$).

3. A method of implementing a body-biased current mirror circuit, the method comprising:

providing a first current mirror device (60) configured to be driven by a first reference voltage ($V_{CS}$);

providing a first body feedback amplifier (50) coupled to the first current mirror device (60), the first body feedback amplifier (50) configured to regulate a body voltage of the first current mirror device (60) as a function of an output voltage of the first current mirror device (60); and providing a first load element (40) having an output coupled to an output of the first body feedback amplifier (50); a body of the first load element (40) further coupled to a body of the first body feedback amplifier (50).

4. The body-biased current mirror circuit according to claim 1, wherein the first body feedback amplifier (50) comprises a second MOSFET.

5. The body-biased current mirror circuit according to claim 1, wherein the first body feedback amplifier (50) comprises a MOSFET selected from the group consisting of a zero-threshold voltage MOSFET and a low-threshold voltage MOSFET.

6. The body-biased current mirror circuit according to claim 2, wherein the first reference voltage ($V_{CS}$) and the second reference voltage ($V_{LREF}$) are generated by a reference bias generation circuit (500), the reference bias generation circuit (500) comprising:

a current reference generator circuit (300), which generates the first reference voltage ($V_{CS}$);

a replica body-biased current mirror circuit (250); and a feedback control circuit (400) which generates the second reference voltage ($V_{LREF}$).

7. The reference bias generation circuit (500) according to claim 6, wherein the current reference generator circuit (300) comprises:

a current source (70); and a diode-connected MOSFET reference device (80) coupled to the current source (70), the diode-connected MOSFET reference device (80) having an output that provides the first reference voltage ($V_{CS}$).

8. The reference bias generation circuit (500) according to claim 6, wherein the replica body-biased current mirror circuit (250) comprises:

a second current mirror device (560) driven by the first reference voltage ($V_{CS}$);

a second body feedback amplifier (550) coupled to the second current mirror device (560), the second body feedback amplifier (550) configured to regulate a body voltage of the second current mirror device (560) as a function of an output voltage of the second current mirror device (560); and a second load element (540) having an output coupled to an output of the second body feedback amplifier (550); a body of the second load element (540) further coupled to a body of the second body feedback amplifier (550).

9. The reference bias generation circuit (500) according to claim 6, wherein the feedback control circuit (400) comprises:

an operational amplifier (111) which generates the second reference voltage ($V_{LREF}$).

10. The reference bias generation circuit (500) according to claim 6, wherein:

the first reference voltage ($V_{CS}$) generated by the current reference generator circuit (300) drives the second current mirror device (560);

the second reference voltage ($V_{LREF}$) generated by an output of the operational amplifier (111) in the feedback control circuit (400) drives the second load element (540);

a body of the diode-connected MOSFET reference device (80) is coupled to a body of the second current mirror device (560); and the operational amplifier (111) having a first input coupled to the body of the diode-connected MOSFET reference device (80) and to the body of the second current mirror device (560), and a second input coupled to a third reference voltage ($V_{BREF}$).

11. The reference bias generation circuit (500) according to claim 10, wherein the third reference voltage ($V_{BREF}$) corresponds to a value to prevent forward biasing a body-to-diffusion junction of the second current mirror device (560).

12. The body-biased current mirror circuit according to claim 6, further comprising an array of body-biased current mirror circuit (200) instances coupled to the reference bias generation circuit (500).

13. The body-biased current mirror circuit according to claim 6, further comprising an auxiliary current mirror device (115) having an output coupled to an output of the first current mirror device (60); a gate of the auxiliary current mirror device (115) further coupled to a gate of the first current mirror device (60); a source of the auxiliary current mirror device (115) further coupled to a source of the first current mirror device (60); a body of the auxiliary current mirror device (115) further coupled to ground.

14. The method according to claim 3, wherein providing the first load element (40) comprises providing a first MOSFET having a gate voltage regulated by a second reference voltage ($V_{LREF}$).

15. The method according to claim 3, wherein providing the first body feedback amplifier (50) comprises providing a second MOSFET.

16. The method according to claim 3, wherein providing the first body feedback amplifier (50) comprises providing a MOSFET selected from the group consisting of a zero-threshold voltage MOSFET and a low-threshold voltage MOSFET.

17. The method according to claim 14, wherein the first reference voltage ($V_{CS}$) and the second reference voltage ($V_{LREF}$) are generated by a reference bias generation circuit (500), a method of implementing the reference bias generation circuit (500) comprising:

providing a current reference generator circuit (300) configured to generate the first reference voltage ($V_{CS}$);

providing a replica body-biased current mirror circuit (250); and providing a feedback control circuit (400) which generates the second reference voltage ($V_{LREF}$).

18. The method according to claim 17, wherein a method of providing the current reference generator circuit (300) comprises:

providing a current source (70); and providing a diode-connected MOSFET reference device (80) coupled to the current source (70), the diode-connected MOSFET reference device (80) having an output that provides the first reference voltage ($V_{CS}$).

19. The method according to claim 17, wherein a method of providing the replica body-biased current mirror circuit (250) comprises:

providing a second current mirror device (560) configured to be driven by the first reference voltage ($V_{CS}$);

providing a second body feedback amplifier (550) coupled to the second current mirror device (560), the second body feedback amplifier (550) configured to regulate a body voltage of the second current mirror device (560) as a function of an output voltage of the second current mirror device (560); and providing a second load element (540) having an output coupled to an output of the second body feedback amplifier (550); a body of the second load element (540) further coupled to a body of the second body feedback amplifier (550).

20. The method according to claim 17, wherein a method of providing the feedback control circuit (400) comprises:

providing an operational amplifier (111) which generates the second reference voltage ($V_{LREF}$).

21. The method according to claim 17, wherein a method of providing the reference bias generation circuit (500) comprises:

providing the first reference voltage ($V_{CS}$) generated by the current reference generator circuit (300) to drive the second current mirror device (560);

providing the second reference voltage ($V_{LREF}$) generated by an output of the operational amplifier (111) in the feedback control circuit (400) to drive the second load element (540);

coupling a body of the diode-connected MOSFET reference device (80) to a body of the second current mirror device (560); and configuring the operational amplifier (111) to have a first input coupled to the body of the diode-connected MOSFET reference device (80) and to the body of the second current mirror device (560), and to have a second input coupled to a third reference voltage ($V_{BREF}$).

22. The method according to claim 21, wherein the third reference voltage ($V_{BREF}$) corresponds to a value to prevent forward biasing a body-to-diffusion junction of the second current mirror device (560).

23. The method according to claim 17, further comprising providing an array of body-biased current mirror circuit (200) instances coupled to the reference bias generation circuit (500).

24. The method according to claim 17, further comprising providing an auxiliary current mirror device (115) having an output coupled to an output of the first current mirror device (60); a gate of the auxiliary current mirror device (115) further coupled to a gate of the first current mirror device (60); a source of the auxiliary current mirror device (115) further coupled to a source of the first current mirror device (60); a body of the auxiliary current mirror device (115) further coupled to ground.

* * * * *